US010060271B2

(12) United States Patent
Schwarz et al.

(10) Patent No.: US 10,060,271 B2
(45) Date of Patent: Aug. 28, 2018

(54) FAN AIRFOIL SHROUDS WITH AREA RULING IN THE SHROUDS

(71) Applicant: UNITED TECHNOLOGIES CORPORATION, Farmington, CT (US)

(72) Inventors: Frederick M. Schwarz, Glastonbury, CT (US); Michael A. Weisse, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 446 days.

(21) Appl. No.: 14/768,103

(22) PCT Filed: Dec. 18, 2013

(86) PCT No.: PCT/US2013/076056

§ 371 (c)(1),
(2) Date: Aug. 14, 2015

(87) PCT Pub. No.: WO2014/143292

PCT Pub. Date: Sep. 18, 2014

(65) Prior Publication Data

US 2015/0377036 A1 Dec. 31, 2015

Related U.S. Application Data

(60) Provisional application No. 61/873,589, filed on Sep. 4, 2013, provisional application No. 61/790,286, filed on Mar. 15, 2013.

(51) Int. Cl.
*F01D 5/22* (2006.01)
*F01D 5/02* (2006.01)
(Continued)

(52) U.S. Cl.
CPC ..... *F01D 5/225* (2013.01); *F01D 5/02* (2013.01); *F01D 5/141* (2013.01); *F01D 9/04* (2013.01);
(Continued)

(58) Field of Classification Search
CPC ... F01D 5/22; F01D 5/225; F01D 5/24; F01D 5/02; F01D 5/141; F01D 9/04;
(Continued)

(56) References Cited

U.S. PATENT DOCUMENTS 2,772,854 A * 12/1956 Rene Anxionnaz ..... F01D 5/22 416/190
4,012,165 A * 3/1977 Kraig ..... F04D 19/022 137/15.1
(Continued)

FOREIGN PATENT DOCUMENTS

JP 09-209704 A 8/1997
WO 2014099634 A2 6/2014

OTHER PUBLICATIONS

European Search Report for Application No. EP 13 87 7583.
International Search Report Application No. PCT/US2013/076056; reported on Apr. 15, 2014.

*Primary Examiner* — Mark Laurenzi
*Assistant Examiner* — Xiaoting Hu
(74) *Attorney, Agent, or Firm* — Cantor Colburn LLP

(57) ABSTRACT

A shrouded airfoil may have a suction surface and a pressure surface. An at least first suction surface shroud may be disposed on the suction surface and an at least first pressure surface shroud may be disposed on the pressure surface. The at least first suction surface shroud may include a first and second contoured surface and a first mating face. The first contoured surface may have a first substantially concave portion and a first substantially convex portion. The second contoured surface may have a second substantially concave
(Continued)

portion and a second substantially convex portion. The at least first pressure surface shroud may include a third and fourth contoured surface and a second mating face. The third contoured surface may have a third substantially concave portion and a third substantially convex portion. The fourth contoured surface may have a fourth substantially concave portion and a fourth substantially convex portion.

17 Claims, 4 Drawing Sheets

(51) Int. Cl.
*F01D 5/14* (2006.01)
*F01D 9/04* (2006.01)
*F04D 29/32* (2006.01)
*F01D 25/24* (2006.01)

(52) U.S. Cl.
CPC ..... *F01D 25/24* (2013.01); *F04D 29/324* (2013.01); *F04D 29/326* (2013.01); *F05D 2220/32* (2013.01); *F05D 2220/36* (2013.01); *F05D 2230/60* (2013.01)

(58) Field of Classification Search
CPC .. F01D 25/24; F05D 2220/36; F05D 2220/32; F05D 2230/60; F04D 29/324; F04D 29/326
See application file for complete search history.

(56) References Cited

U.S. PATENT DOCUMENTS

| | | | | |
|---|---|---|---|---|
| 4,326,836 | A * | 4/1982 | Fitton | F01D 5/22 416/196 R |
| 5,137,426 | A * | 8/1992 | Rhoda | C23C 4/02 416/191 |
| 5,667,361 | A | 9/1997 | Yaeger et al. | |
| 8,118,557 | B2 | 2/2012 | Demania et al. | |
| 8,182,228 | B2 * | 5/2012 | Riley | B23P 6/005 29/889.7 |
| 9,506,353 | B2 * | 11/2016 | Schwarz | F01D 5/225 |
| 2005/0169760 | A1 * | 8/2005 | Dube | F01D 5/147 416/223 R |
| 2009/0047132 | A1 | 2/2009 | Riley et al. | |
| 2009/0081039 | A1 * | 3/2009 | McCune | F02C 7/04 415/214.1 |
| 2010/0196684 | A1 | 8/2010 | Memmen et al. | |
| 2014/0169974 | A1 * | 6/2014 | Chouhan | F01D 5/225 416/212 A |

* cited by examiner

FAN AIRFOIL SHROUDS WITH AREA RULING IN THE SHROUDS

CROSS-REFERENCE TO RELATED APPLICATION

This patent application is a US National Stage under 35 U.S.C. § 371 of International Application No. PCT/US2013/076056 filed on Dec. 18, 2013, claiming priority under 35 U.S.C. § 119(e) to U.S. Patent Application Ser. Nos. 61/873,589 filed on Sep. 4, 201, and 61/790,286 filed on Mar. 15, 2013.

TECHNICAL FIELD

The subject matter of the present disclosure relates generally to gas turbine engines and, more particularly, relates to shrouded airfoils.

BACKGROUND

Shrouds are employed on some airfoils in gas turbine engines to prevent, during operation, twisting of the airfoils and to eliminate certain airfoil vibration modes. Generally, the shrouds extend laterally between adjacent rotor airfoils. Shrouds that extend laterally between the tips of adjacent airfoils are referred to as tip shrouds. Shrouds that are located intermediate of the airfoil dovetail and the airfoil tip are commonly referred to as mid-span shrouds. However, the term mid-span shroud has expanded to also include shrouds that are located anywhere along the airfoil span, not just at the midpoint span.

The shrouds extend laterally from the airfoil such that one shroud projects from the pressure surface and another shroud projects from the suction surface of each airfoil. When the engine is operating the suction surface shroud of each airfoil abuts the pressure surface shroud of the adjacent airfoil so that the shrouds define a shroud ring that provides support to the airfoils. The shroud ring resists vibration and twisting of the airfoils.

Shrouds were gradually eliminated from high thrust engine designs a few decades ago because the shrouds caused an efficiency loss in the fan rotor because they represent a source of drag in that the airflow is at rather high mach number and the flow around the shroud is diverted around the shroud. Consequently, modern fan rotors of turbofan engines with large diameters and high bypass ratios typically use wide chord airfoils without shrouds. However, eliminating the shrouds from the airfoils has negative consequences such as increased engine weight and increased fuel consumption. Without the shrouds, the engine design requires that the chord of the airfoil be increased and the airfoil count be reduced. These so-called wide chord airfoils without shrouds are typically fewer in number than the so-called narrow chord airfoils but each individual wide chord airfoil is much heavier so the net effect is an increase in engine weight. These changes also add engine length, fan airfoil weight that must be contained by a heavier fan airfoil containment system, and fan disk weight to manage the heavier fan airfoils and containment system weight. Additionally, use of the wide chord airfoil without the shroud that eliminated fan airfoil flutter may require the addition of a variable area fan nozzle to eliminate airfoil vibration, which has a very high system weight penalty.

Although eliminating the shrouds improves fan rotor efficiency, the extra weight added to the overall engine is a great detriment to fuel consumption efficiency. Thus, there is a need for a gas turbine engine which maintains aerodynamic efficiency of the fan airfoils and shrouds while also reducing engine weight.

SUMMARY

In accordance with an aspect of the disclosure, a shrouded airfoil is provided. The airfoil may include a tip, a dovetail, a suction surface and a pressure surface. At least a first suction surface shroud may be disposed on the suction surface. The at least first suction surface shroud may include a first and second contoured surface and a first mating face. The first contoured surface may have a first substantially concave portion and a first substantially convex portion. The second contoured surface may have a second substantially concave portion and a second substantially convex portion. At least a first pressure surface shroud may be disposed on the pressure surface. The at least first pressure surface shroud may include a third and fourth contoured surface and a second mating face. The third contoured surface may have a third substantially concave portion and a third substantially convex portion. The fourth contoured surface may have a fourth substantially concave portion and a fourth substantially convex portion.

In accordance with another aspect of the disclosure, the first contoured surface may include a first contoured section which forms an angle $\alpha$ with respect to the first mating face, the second contoured surface may include a second contoured section which forms an angle $\gamma$ with respect to the first mating face, the third contoured surface may include a third contoured section which forms an angle $\beta$ with respect to the second mating face, and the fourth contoured surface may include a fourth contoured section which forms angle $\theta$ with respect to the second mating face, the angles $\alpha,\beta,\gamma,\theta$ may be approximately less than 90 degrees.

In accordance with yet another aspect of the disclosure, the first mating face may be non-orthogonal and non-parallel to the suction surface and the second mating face may be non-orthogonal and non-parallel to the pressure surface.

In accordance with still another aspect of the disclosure, the at least first suction surface shroud extends laterally from the suction surface and the at least first pressure surface shroud extends laterally from the pressure surface.

In accordance with still yet another aspect of the disclosure, the first substantially concave portion may be located between the suction surface and the first substantially convex portion, the first substantially convex portion may be located between the first substantially concave portion and the first mating face, the second substantially concave portion may be located between the suction surface and the second substantially convex portion, the second substantially convex portion may be located between the second substantially concave portion and the first mating face, the third substantially concave portion may be located between the pressure surface and the third substantially convex portion, the third substantially convex portion may be located between the third substantially concave portion and the second mating face, and the fourth substantially concave portion may be located between the pressure surface and the fourth substantially convex portion, the fourth substantially convex portion may be located between the fourth substantially concave portion and the second mating face.

In further accordance with another aspect of the disclosure, a second suction surface shroud and a second pressure surface shroud may be included.

In accordance with another aspect of the disclosure, a gas turbine engine is provided. The gas turbine engine may include a rotor disk and a plurality of airfoils arranged in a circumferential direction around the rotor disk. Each of the plurality of airfoils may include a tip, a dovetail, a suction surface and a pressure surface. At least a first suction surface shroud may be disposed on each suction surface of each of the plurality of airfoils. Each of the at least first suction surface shrouds may include a first and second contoured surface and a first mating face. Each of the first contoured surfaces may include a first substantially concave portion and a first substantially convex portion. Each of the second contoured surfaces may have a second substantially concave portion and a second substantially convex portion. At least a first pressure surface shroud may be disposed on each pressure surface of each of the plurality of airfoils. Each of the at least first pressure surface shrouds may include a third and fourth contoured surface and a second mating face. Each of the third contoured surfaces may have a third substantially concave portion and a third substantially convex portion. Each of the fourth contoured surfaces may have a fourth substantially concave portion and a fourth substantially convex portion.

In accordance with yet another aspect of the disclosure, each of the first contoured surfaces may include a first contoured section which forms an angle $\alpha$ with respect to its first mating face, each of the second contoured surfaces may include a second contoured section which forms an angle $\gamma$ with respect to its first mating face, each of the third contoured surfaces may include a third contoured section which forms an angle $\beta$ with respect to its second mating face, and each of the fourth contoured surfaces may include a fourth contoured section which forms angle $\theta$ with respect to its second mating face. The angles $\alpha,\beta,\gamma,\theta$ may be approximately less than 90 degrees.

In accordance with still another aspect of the disclosure, each of the first mating faces may be non-orthogonal and non-parallel to its respective suction surface and each of the second mating faces may be non-orthogonal and non-parallel to its respective pressure surface.

In accordance with still yet another aspect of the disclosure, each of the at least first suction surface shrouds may extend laterally from its respective suction surface and each of the first pressure surface shrouds may extend laterally from its respective pressure surface.

In further accordance with another aspect of the disclosure, each of the first substantially concave portions may be located between its respective suction surface and its respective first substantially convex portion, each of the first substantially convex portions may be located between its respective first substantially concave portion and its respective first mating face, each of the second substantially concave portions may be located between its respective suction surface and its respective second substantially convex portion, each of the second substantially convex portions may be located between its respective second substantially concave portion and its respective first mating face, each of the third substantially concave portions may be located between its respective pressure surface and its respective third substantially convex portion, each of the third substantially convex portions may be located between its respective third substantially concave portion and its respective second mating face, each of the fourth substantially concave portions may be located between its respective pressure surface and its respective fourth substantially convex portion, and each of the fourth substantially convex portions may be located between its respective fourth substantially concave portion and its respective second mating face.

In further accordance with yet another aspect of the disclosure, the first and second substantially convex portions may form a center diamond region with the third and fourth substantially convex portions of an adjacent airfoil when the first mating face is in operational contact with the second mating face of the adjacent airfoil, the center diamond region having dimensions that maximize resistance of shingling and wear of each of the at least first suction surface shrouds and each of the at least first pressure surface shrouds.

In further accordance with still another aspect of the disclosure, the first and second substantially concave portions collectively form an area-ruled region with the third and fourth substantially concave portions of the adjacent airfoil when the first mating face is in operational contact with the second mating face of the adjacent airfoil, the area-ruled region having dimensions that allow spreading streamtubes over the center diamond region to flow into the area-ruled region creating the effect of having each of the at least first pressure and suction surface shrouds disappear so that aerodynamic drag is minimized and engine operating efficiency is increased.

In further accordance with still yet another aspect of the disclosure, each of the at least first suction surface shrouds may be located on each airfoil at a position that may be aligned approximately with a circumferential plane of an upstream outer edge of a core engine cowl of the gas turbine engine, so that each of the at least first suction surface shrouds refrain from impeding air flow into an inlet of the gas turbine engine. Each of the at least first pressure surface shrouds may be located on each airfoil at a position that may be aligned approximately with the circumferential plane of the upstream outer edge of the core engine cowl of the gas turbine engine, so that each of the at least first pressure surface shrouds refrain from impeding air flow into the inlet of the gas turbine engine.

In further accordance with another aspect of the disclosure, the plurality of airfoils may include more than twenty-four airfoils, the engine may have a bypass ratio greater than six, the engine may further include a fan nozzle disposed adjacent to the aft end of the engine and a gearbox operatively connected to the airfoils so as to reduce the rotational speed of the airfoils, and the fan nozzle may have a constant area.

In accordance with another aspect of the disclosure, a method of manufacturing an airfoil is provided. The method entails forming an airfoil having a suction surface and a pressure surface. The method may also entail providing at least one suction surface shroud onto the suction surface. Another step may include providing a first and second substantially concave portion and a first and second substantially convex portion onto the at least one suction surface shroud. Yet another step may include providing at least one pressure surface shroud onto the pressure surface. Still yet another step may include providing a third and fourth substantially concave portion and a third and fourth substantially convex portion onto the at least one pressure surface shroud.

In accordance with yet another aspect of the disclosure, manufacturing the airfoil may include forming the at least first suction surface shroud to include a first contoured section which forms an angle $\alpha$ with respect to a first mating face of the at least first suction surface shroud and to include a second contoured section which forms an angle $\gamma$ with respect to the first mating face, and forming the at least first pressure surface shroud to include a third contoured section which forms an angle $\beta$ with respect to a second mating face of the at least first pressure surface shroud and to include a fourth contoured section which forms an angle θ with respect to the second mating face.

In accordance with still yet another aspect of the disclosure, manufacturing the airfoil may include forming the first and second substantially convex portions of the airfoil so as to operationally form a center diamond region with third and fourth substantially convex portions of an adjacent airfoil, the center diamond region having dimensions that, during operation of a gas turbine engine, maximize resistance of shingling and wear of the at least first suction surface shroud and the at least first pressure surface shroud.

In further accordance with yet another aspect of the disclosure, manufacturing the airfoil may include forming the first and second substantially concave portions so as to operatively form an area-ruled region collectively with third and fourth substantially concave portions of the adjacent airfoil, the area-ruled region having dimensions that, during operation of a gas turbine engine, allow spreading streamtubes over the center diamond region to flow into the area-ruled region creating the effect of having the at least first pressure and suction surface shrouds disappear so that aerodynamic drag may be minimized and engine operating efficiency may be increased.

Other aspects and features of the disclosed systems and methods will be appreciated from reading the attached detailed description in conjunction with the included drawing figures. Moreover, selected aspects and features of one example embodiment may be combined with various selected aspects and features of other example embodiments.

BRIEF DESCRIPTION OF THE DRAWINGS

For further understanding of the disclosed concepts and embodiments, reference may be made to the following detailed description, read in connection with the drawings, wherein like elements are numbered alike, and in which.

It is to be noted that the appended drawings illustrate only certain illustrative embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Figure 1:
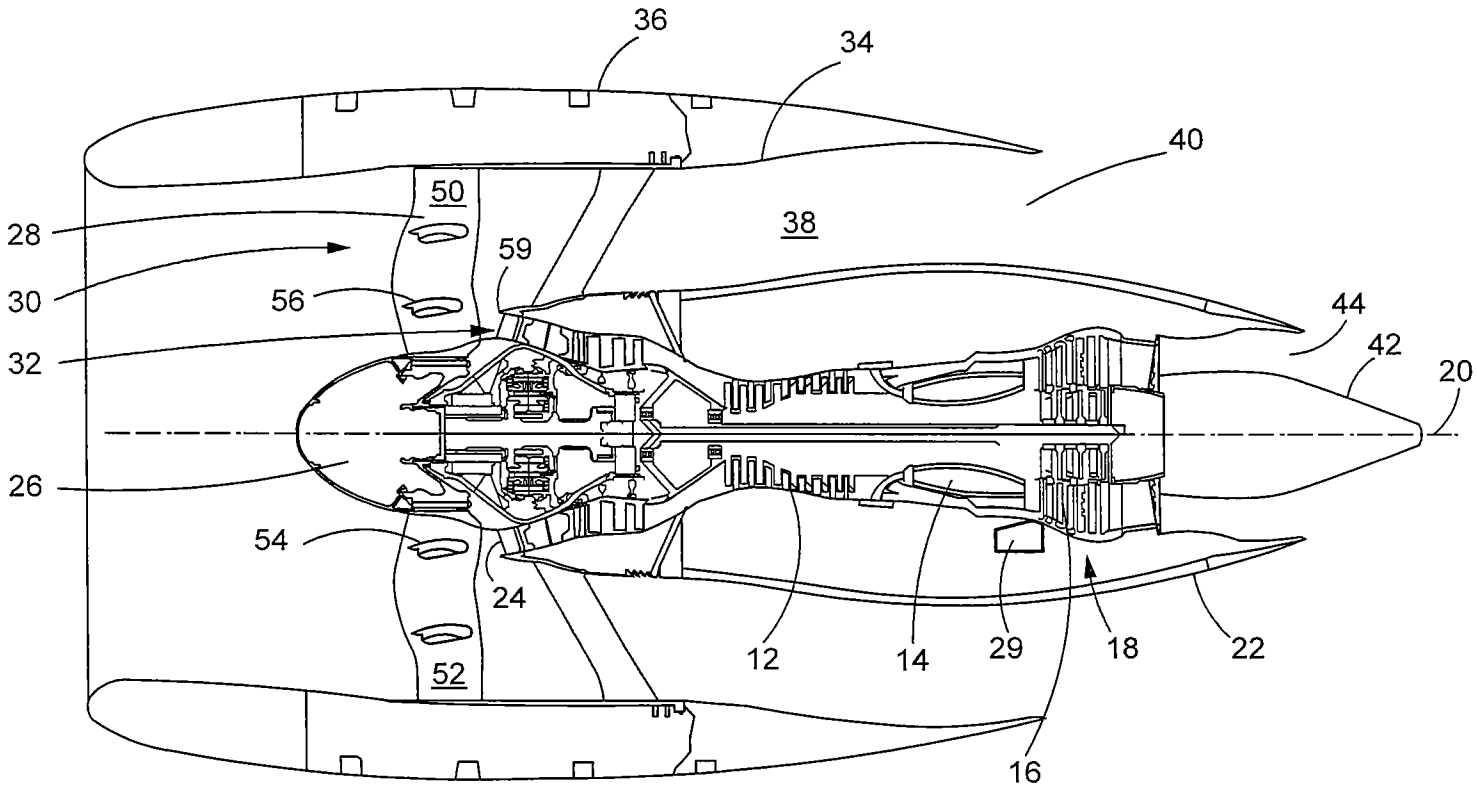
FIG. 1 is a schematic side view of a gas turbine engine with portions of the nacelle thereof sectioned and broken away to show details of the present disclosure.

Referring now to FIG. 1, a gas turbine engine constructed in accordance with the present disclosure is generally referred to by reference numeral 10. The gas turbine engine 10 includes a compressor 12, a combustor 14 and a turbine 16. The serial combination of the compressor 12, the combustor 14 and the turbine 16 is commonly referred to as a core engine 18. The core engine 18 lies along a longitudinal central axis 20. A core engine cowl 22 surrounds the core engine 18.

Air enters compressor 12 at an inlet 24 and is then pressurized. The pressurized air subsequently enters the combustor 14. In the combustor 14, the air mixes with fuel and is burned, generating hot combustion gases that flow downstream to the turbine 16. The turbine 16 extracts energy from the hot combustion gases to drive the compressor 12 and a fan 26 having airfoils 28. A fan speed reducing gearbox 29 may be operatively connected to the turbine 16 and the fan 26 so as to lower the rotation speed of the airfoils 28 and the fan 26 thereby lowering the air velocity through the fan 26. As the turbine 16 drives the fan 26, the airfoils 28 rotate so as to take in ambient air. This process accelerates the ambient air flow 30 to provide the majority of the useful thrust produced by the engine 10. Generally, in modern gas turbine engines, the fan 26 has a much greater diameter than the core engine 18. Because of this, the ambient air flow 30 through the fan 26 can be 5-10 times higher, or more, than the combustion air flow 32 through the core engine 18. The ratio of ambient air flow 30 through the fan 26 relative to the combustion air flow 32 through the core engine 18 is known as the bypass ratio. As a non-limiting example, the bypass ratio for engine 10 may be greater than 6.

The fan 26 and core engine cowl 22 are surrounded by a fan cowl 34 forming part of a nacelle 36. A fan duct 38 is functionally defined by the area between the core engine cowl 22 and the fan cowl 34. The fan duct 38 is substantially annular in shape so that it can accommodate the air flow produced by the fan 26. This ambient air flow 30 travels the length of the fan duct 38 and exits downstream at a fan nozzle 40. The fan nozzle 40 may be a non-variable area fan nozzle. A tail cone 42 may be provided at the core engine exhaust nozzle 44 to smooth the discharge of excess hot combustion gases that were not used by the turbine 16 to drive the compressor 12 and the fan 26. The core engine exhaust nozzle 44 is the annular area located between the trailing rim of the core engine 18 and the tail cone 42.

Figure 2:
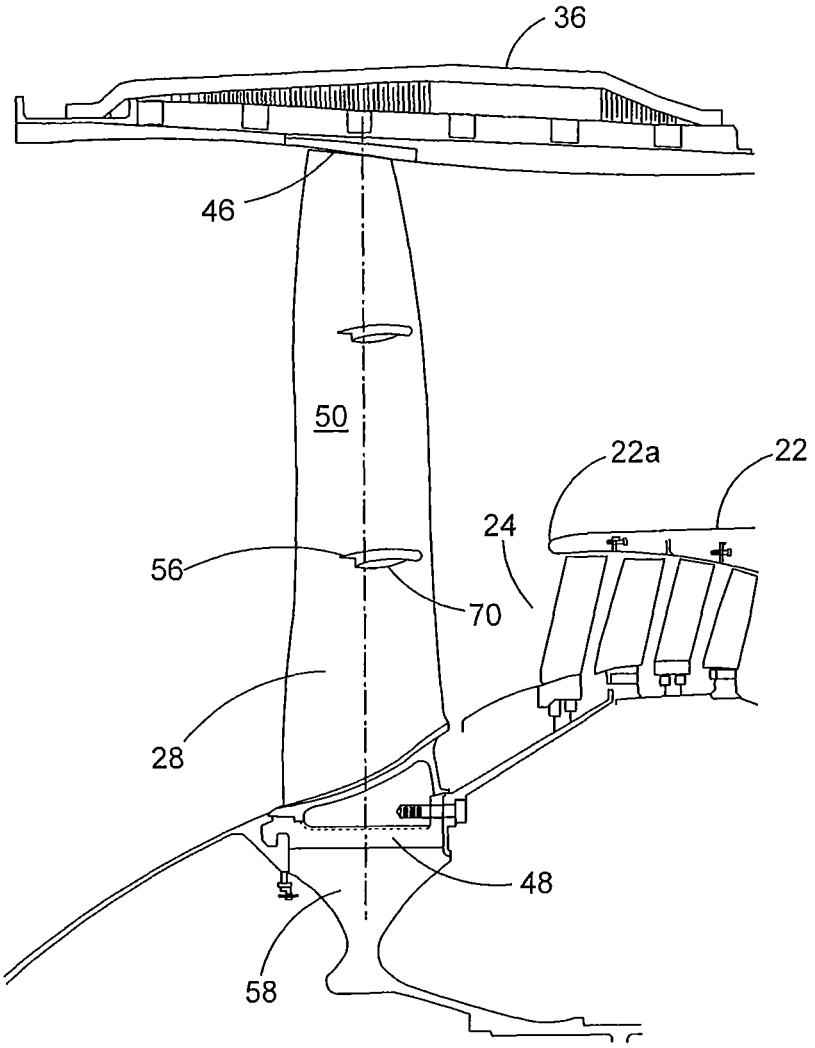
FIG. 2 is a partially cross-sectioned side view of a shrouded airfoil constructed in accordance with the teachings of this disclosure.

As shown in FIGS. 1 and 2, the airfoil 28 has a tip 46, a dovetail 48, a pressure surface 50 and a suction surface 52. A suction surface shroud 54 extends laterally from the suction surface 52 of each airfoil 28 and a pressure surface shroud 56 extends laterally from the pressure surface 50 of each airfoil 28. The airfoils 28 are arranged in a circumferential direction around a rotor disk 58. The shrouds 54, 56 are preferably located on each airfoil 28 at a position that is aligned approximately with the circumferential plane of the upstream outer edge 59 of the core engine cowl 22, so that the shrouds 54, 56 refrain from impeding air flow 32 into the inlet 24.

Figure 5:
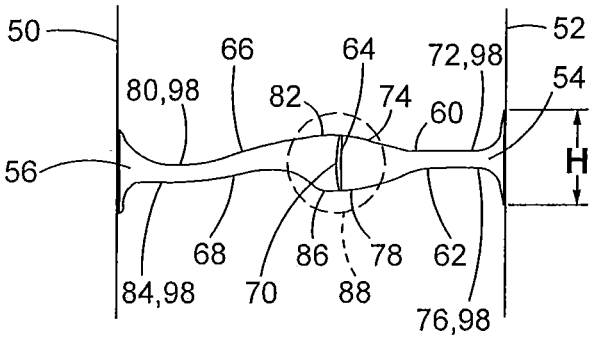
FIG. 5 is a front view of two shrouded airfoils as looking along line 5-5 of FIG. 3 constructed in accordance with this disclosure.

The suction surface shroud 54 and the pressure surface shroud 56 will be described in more detail below with particular reference to FIGS. 3 and 5. The suction surface shroud 54 may include a first contoured surface 60, a second contoured surface 62, and a first mating face 64. Similarly, the pressure surface shroud 56 may include a third contoured surface 66, a fourth contoured surface 68, and a second mating face 70. The first and second mating faces 64, 70 may be substantially elliptical such that the first and second mating faces 64, 70 may have a distance H, measured along the minor axis of the elliptical shape that is approximately less than a distance L, measured along the major axis of the elliptical shape. Because the airfoils 28 are arranged in a circumferential direction around the rotor disk 58, during operation of the engine, the airfoils 28 twist so that each first mating face 64 of each suction surface shroud 54 comes into contact with a corresponding second mating face 70 of an adjacent airfoil 28. When the shrouds 54, 56 are engaged in this manner the shrouds 54, 56 describe a shroud ring, which prevents further twisting and vibration of the airfoils 28. The shrouds 54, 56 disengage from one another as the engine 10 shuts down.

The first contoured surface 60 of the suction surface shroud 54 may include a first substantially concave portion 72 and a first substantially convex portion 74. The first substantially concave portion 72 may be located between the suction surface 52 and the first substantially convex portion 74. The first substantially convex portion 74 may be located between the first substantially concave portion 72 and the first mating face 64. In similar fashion, the second contoured surface 62 of the suction surface shroud 54 may include a second substantially concave portion 76 and a second substantially convex portion 78. The second substantially concave portion 76 may be located between the suction surface 52 and the second substantially convex portion 78. The second substantially convex portion 78 may be located between the second substantially concave portion 76 and the first mating face 64.

The pressure surface shroud 56 may be constructed in a similar manner. The third contoured surface 66 may include a third substantially concave portion 80 and a third substantially convex portion 82. The third substantially concave portion 80 may be located between the pressure surface 50 and the third substantially convex portion 82. The third substantially convex portion 82 may be located between the third substantially concave portion 80 and the second mating face 70. In like manner, the fourth contoured surface 68 may include a fourth substantially concave portion 84 and a fourth substantially convex portion 86. The fourth substantially concave portion 84 may be located between the pressure surface 50 and the fourth substantially convex portion 86. The fourth substantially convex portion 86 may be located between the fourth substantially concave portion 84 and the second mating face 70.

When the first mating face 64 is operatively engaged with the second mating face 70 of an adjacent airfoil 28 the first through fourth substantially convex portions 74, 78, 82, 86 form a center diamond region 88. Because the center diamond region 88 includes the first and second mating faces 64, 70, the center diamond region 88 may be designed to maximize resistance of shingling and wear of the shrouds 54, 56. The center diamond region 88 cannot be reduced below a certain area and wheelbase. The mating faces 64, 70 may be orientated such that they are non-orthogonal and non-parallel to the suction surface 52 and pressure surface 50, respectively.

Figure 3:
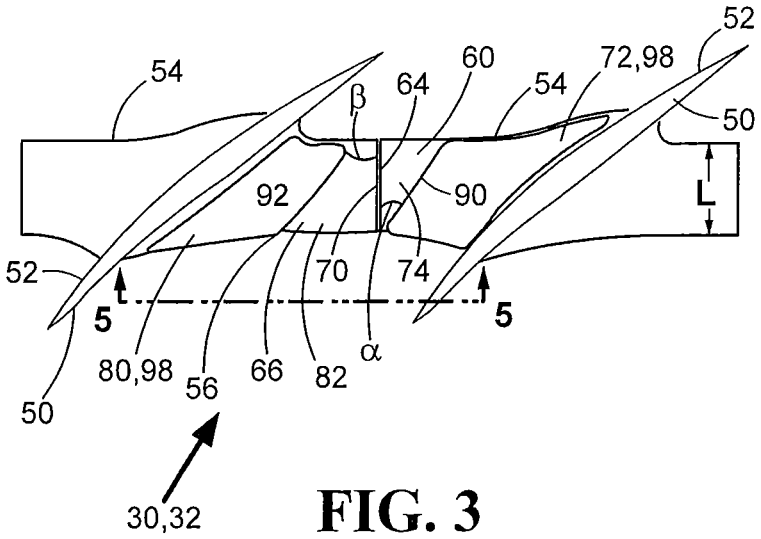
FIG. 3 is a perspective view of two adjacent shrouded airfoils of the gas turbine engine of FIG. 1 constructed in accordance with this disclosure.

As best seen in FIG. 3, the first contoured surface 60 may include a first contoured section 90 where the first substantially convex portion 74 may be adjacent to the first substantially concave portion 72. The first contoured section 90 may form an angle $\alpha$ with respect to the first mating face 64 such that the angle $\alpha$ may be approximately less than 90 degrees. The third contoured surface 66 may include a third contoured section 92 where the third substantially convex portion 82 may be adjacent to the third substantially concave portion 80. The third contoured section 92 may form an angle $\beta$ with respect to the second mating face 70 such that the angle $\beta$ may be approximately less than 90 degrees. The first and third contoured sections 90, 92 may be approximately parallel to each other and to the inter-airfoil air flow direction.

Figure 4:
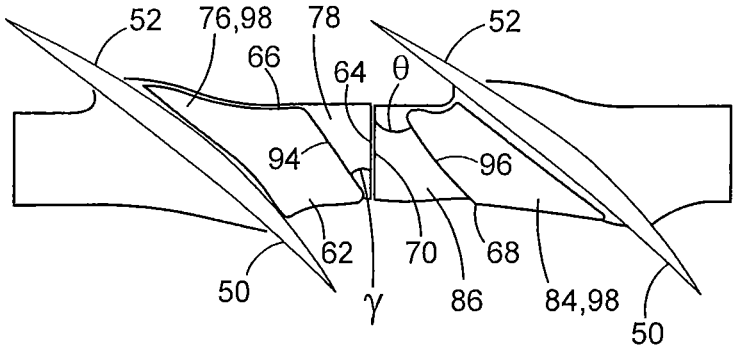
FIG. 4 is a perspective view of the two adjacent shrouded airfoils of FIG. 3 from the opposite direction.

Referring to FIG. 4, the second contoured surface 62 may include a second contoured section 94 where the second substantially convex portion 78 may be adjacent to the second substantially concave portion 76. The second contoured section 94 may form an angle $\gamma$ with respect to the first mating face 64 such that the angle $\gamma$ may be approximately less than 90 degrees. The fourth contoured surface 68 may include a fourth contoured section 96 where the fourth substantially convex portion 86 may be adjacent to the fourth substantially concave portion 84. The fourth contoured section 96 may form an angle $\theta$ with respect to the second mating face 70 such that the angle $\theta$ may be approximately less than 90 degrees. The second and fourth contoured sections 94, 96 may be approximately parallel to each other and to the inter-airfoil air flow direction.

During engine 10 operation, the first through fourth substantially concave portions 72, 76, 80, 84 collectively form an area-ruled region 98. As the air 30, 32 flows between each airfoil 28, the area-ruled region 98 allows the spreading streamtubes of air flow 30, 32 over the center diamond region 88 to move into the substantially concave portions 72, 76, 80, 84 creating a more aerodynamic streamlined airflow path over the shrouds 54, 56. This effectively minimizes aerodynamic drag and increases engine operating efficiency.

Figure 6:
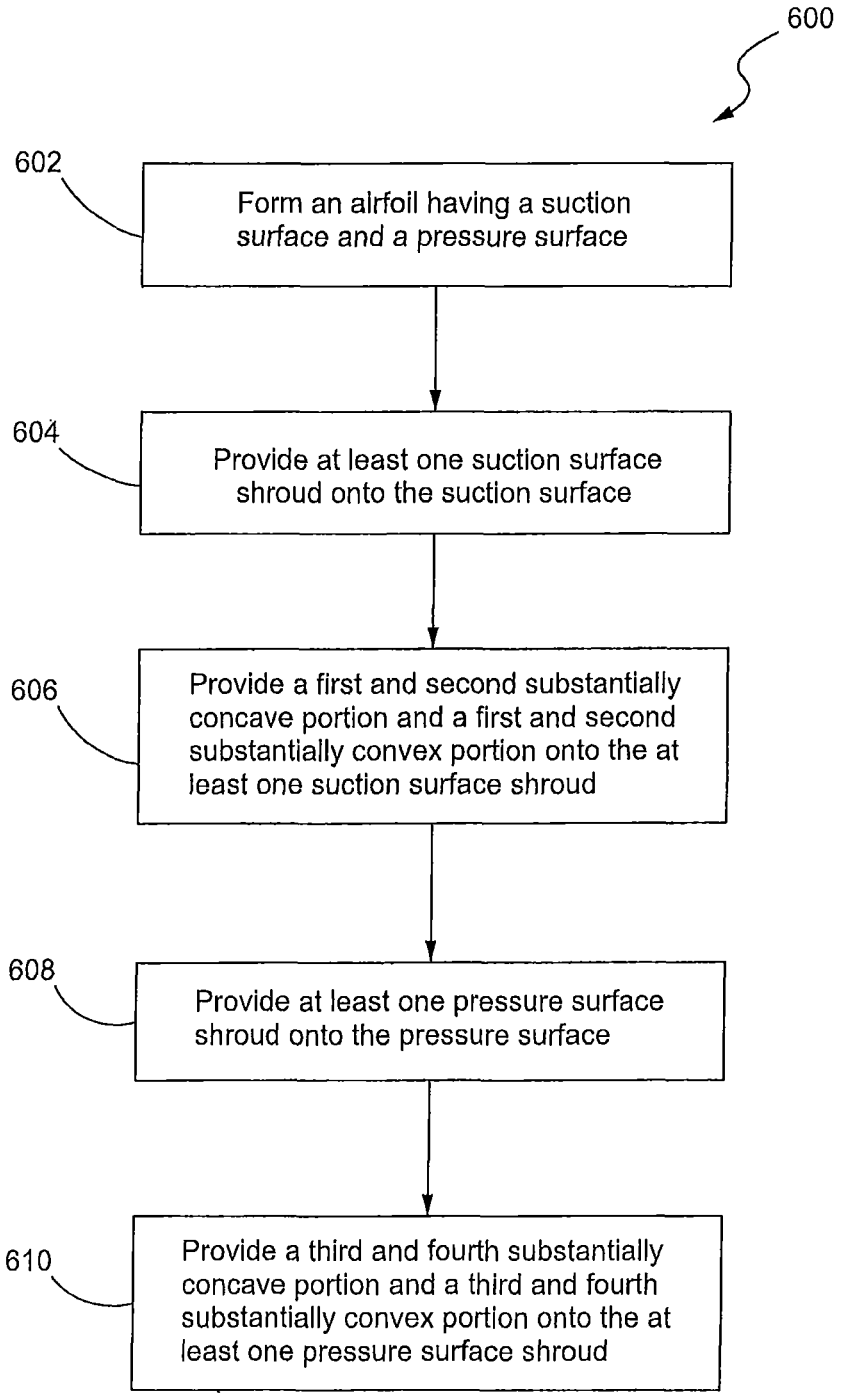
FIG. 6 is a flowchart illustrating a sample sequence of steps which may be practiced in accordance with the present disclosure.

FIG. 6 illustrates a flowchart 600 of a method of manufacturing an aerodynamically shrouded airfoil. Box 602 shows the step of forming an airfoil 28 having a suction surface 52 and a pressure surface 50. Another step, as shown in box 604, is to provide at least one suction surface shroud 54 onto the suction surface 52. Box 606 illustrates another step of providing a first and second substantially concave portion 72,76 and a first and second substantially convex portion 74,78 onto the at least one suction surface shroud 54. Box 608 shows the step of providing at least one pressure surface shroud 56 onto the pressure surface 50. Another step shown in box 610 is providing a third and fourth substantially concave portion 80, 84 and a third and fourth substantially convex portion 82, 86 onto the at least one pressure surface shroud 56.

Although an embodiment may include one suction surface shroud and one pressure surface shroud on each airfoil, an airfoil having multiple suction surface shrouds and multiple pressure surface shrouds also fit within the scope of the present disclosure. As a non-limiting example, shown in FIGS. 1 and 2, a second suction surface shroud may be located on the airfoil 28 between the suction surface shroud 56 and the tip 46 and a second pressure surface shroud may be similarly located between the pressure surface shroud 56 and the tip 46. The engine 10 may include 24 airfoils 28, but is not restricted to this number and may include more or less. The airfoils 28 may be manufactured from materials such as, but not limited to, aluminum, carbon fiber composite, and hollow titanium.

While the present disclosure has shown and described details of exemplary embodiments, it will be understood by one skilled in the art that various changes in detail may be effected therein without departing from the spirit and scope of the disclosure as defined by claims supported by the written description and drawings. Further, where these exemplary embodiments (and other related derivations) are described with reference to a certain number of elements it will be understood that other exemplary embodiments may be practiced utilizing either less than or more than the certain number of elements.

INDUSTRIAL APPLICABILITY

Based on the foregoing, it can be seen that the present disclosure sets forth a shrouded airfoil for use in a gas turbine engine. The teachings of this disclosure can be employed to allow reduction in gas turbine engine weight, while at the same time increasing overall engine efficiency and minimizing aerodynamic drag. Specifically, the shrouded airfoil of the present disclosure reduces individual airfoil weight, reduces pull on the rotor disk and rotor disk weight, and reduces containment system weight.

One beneficial implementation is to use a gas turbine engine with a fan speed reducing mechanism, such as but not limited to a gearbox, to lower the fan speed and lower the air velocity through the fan to inherently reduce the drag encountered when adding the shrouded airfoil. The engine, with a bypass ratio greater than 6, may utilize twenty-four or more airfoils, which may be manufactured from lightweight materials such as, but not limited to, aluminum, carbon fiber composite and hollow titanium, to provide a lighter weight combination of features than prior art engines. Further weight reduction of the engine is possible by removing a variable area fan nozzle because the shrouds make the fan nozzle increase in the proportion of laminar flow achieved in the rotor. In this combination, the gear slows the airfoil to the point where the shrouds produce less loss, the shrouds prevent fan airfoil flutter even with a narrow chord, and the narrow chord allows a greater portion of the fan airfoil to be in laminar flow.

What is claimed is:

1. A shrouded airfoil, comprising:

a tip;

a dovetail;

a suction surface;

a pressure surface;

at least a first suction surface shroud, the at least first suction surface shroud disposed on the suction surface, the at least first suction surface shroud including a first and second contoured surface and a first mating face, the first contoured surface having a first substantially concave portion and a first substantially convex portion, the second contoured surface having a second substantially concave portion and a second substantially convex portion; and at least a first pressure surface shroud, the at least first pressure surface shroud disposed on the pressure surface, the at least first pressure surface shroud including a third and fourth contoured surface and a second mating face, the third contoured surface having a third substantially concave portion and a third substantially convex portion, the fourth contoured surface having a fourth substantially concave portion and a fourth substantially convex portion;

wherein the first contoured surface includes a first contoured section where the first substantially convex portion is adjacent to the first substantially concave portion, the first contoured section forming an angle $\alpha$ with respect to the first mating face, the second contoured surface includes a second contoured section where the second substantially convex portion is adjacent to the second substantially concave portion, the second contoured section forming an angle $\gamma$ with respect to the first mating face, the third contoured surface includes a third contoured section where the third substantially convex portion is adjacent to the third substantially concave portion, the third contoured section forming an angle $\beta$ with respect to the second mating face, and the fourth contoured surface includes a fourth contoured section where the fourth substantially convex portion is adjacent to the fourth substantially concave portion, the fourth contoured section forming an angle $\theta$ with respect to the second mating face, the angles $\alpha$, $\beta$, $\gamma$, $\theta$ each being approximately less than 90 degrees.

2. The shrouded airfoil of claim 1, wherein the first mating face is non-orthogonal and non-parallel to the suction surface and the second mating face is non-orthogonal and non-parallel to the pressure surface.

3. The shrouded airfoil of claim 1, wherein the at least first suction surface shroud extends laterally from the suction surface and the at least first pressure surface shroud extends laterally from the pressure surface.

4. The shrouded airfoil of claim 1, wherein the first substantially concave portion is located between the suction surface and the first substantially convex portion, the first substantially convex portion is located between the first substantially concave portion and the first mating face, the second substantially concave portion is located between the suction surface and the second substantially convex portion, the second substantially convex portion is located between the second substantially concave portion and the first mating face, the third substantially concave portion is located between the pressure surface and the third substantially convex portion, the third substantially convex portion is located between the third substantially concave portion and the second mating face, and the fourth substantially concave portion is located between the pressure surface and the fourth substantially convex portion, the fourth substantially convex portion is located between the fourth substantially concave portion and the second mating face.

5. The shrouded airfoil of claim 1, further including a second suction surface shroud and a second pressure surface shroud.

6. A gas turbine engine, comprising:

a rotor disk;

a plurality of airfoils arranged around the rotor disk, each of the plurality of airfoils including a tip, a dovetail, a suction surface and a pressure surface;

at least a first suction surface shroud disposed on each suction surface of each of the plurality of airfoils, each of the at least first suction surface shrouds including a first and second contoured surface and a first mating face, each of the first contoured surfaces having a first substantially concave portion and a first substantially convex portion, each of the second contoured surfaces having a second substantially concave portion and a second substantially convex portion; and at least a first pressure surface shroud disposed on each pressure surface of each of the plurality of airfoils, each of the at least first pressure surface shrouds including a third and fourth contoured surface and a second mating face, each of the third contoured surfaces having a third substantially concave portion and a third substantially convex portion, each of the fourth contoured surfaces having a fourth substantially concave portion and a fourth substantially convex portion;

wherein each of the first contoured surfaces includes a first contoured section where its first substantially convex portion is adjacent to its first substantially concave portion, each of the first contoured sections forming an angle α with respect to its respective first mating face, each of the second contoured surfaces includes a second contoured section where its second substantially convex portion is adjacent to its second substantially concave portion, each of the second contoured sections forming an angle γ with respect to its respective first mating face, each of the third contoured surfaces includes a third contoured section where its third substantially convex portion is adjacent to its third substantially concave portion, each of the third contoured sections forming an angle β with respect to its respective second mating face, and each of the fourth contoured surfaces includes a fourth contoured section where its fourth substantially convex portion is adjacent to its fourth substantially concave portion, each of the fourth contoured sections forming an angle θ with respect to its respective second mating face, the angles α, β, γ, θ each being approximately less than 90 degrees.

7. The gas turbine engine of claim 6, wherein each of the first mating faces is non-orthogonal and non-parallel to its respective suction surface, and each of the second mating faces is non-orthogonal and non-parallel to its respective pressure surface.

8. The gas turbine engine of claim 6, wherein each of the at least first suction surface shrouds extend laterally from its respective suction surface and each of the at least first pressure surface shrouds extend laterally from its respective pressure surface.

9. The gas turbine engine of claim 6, wherein each of the first substantially concave portions is located between its respective suction surface and its respective first substantially convex portion, each of the first substantially convex portions is located between its respective first substantially concave portion and its respective first mating face, each of the second substantially concave portions is located between its respective suction surface and its respective second substantially convex portion, each of the second substantially convex portions is located between its respective second substantially concave portion and its respective first mating face, each of the third substantially concave portions is located between its respective pressure surface and its respective third substantially convex portion, each of the third substantially convex portions is located between its respective third substantially concave portion and its respective second mating face, and each of the fourth substantially concave portions is located between its respective pressure surface and its respective fourth substantially convex portion, and each of the fourth substantially convex portions is located between its respective fourth substantially concave portion and its respective second mating face.

10. The gas turbine engine of claim 6, wherein the first and second substantially convex portions form a center diamond region with the third and fourth substantially convex portions of an adjacent airfoil when the first mating face is in operational contact with the second mating face of the adjacent airfoil, the center diamond region having dimensions that maximize resistance of shingling and wear of each of the at least first suction surface shrouds and each of the at least first pressure surface shrouds.

11. The gas turbine engine of claim 10, wherein the first and second substantially concave portions collectively form an area-ruled region with the third and fourth substantially concave portions of the adjacent airfoil when the first mating face is in operational contact with the second mating face of the adjacent airfoil, the area-ruled region having dimensions that, during operation of the engine, allow spreading streamtubes over the center diamond region to flow into the area-ruled region creating an aerodynamic streamlined airflow path over the at least first pressure and suction surface shrouds so that aerodynamic drag is minimized and engine operating efficiency is increased.

12. The gas turbine engine of claim 6, wherein each of the at least first suction surface shrouds is located on each airfoil at a position that is aligned approximately with a circumferential plane of an upstream outer edge of a core engine cowl of the gas turbine engine, so that each of the at least first suction surface shrouds refrain from impeding air flow into an inlet of the gas turbine engine and each of the at least first pressure surface shrouds is located on each airfoil at a position that is aligned approximately with the circumferential plane of the upstream outer edge of the core engine cowl of the gas turbine engine, so that each of the at least first pressure surface shrouds refrain from impeding air flow into the inlet of the gas turbine engine.

13. The gas turbine engine of claim 6, further including a second suction surface shroud and a second pressure surface shroud.

14. The gas turbine engine of claim 13, wherein the plurality of airfoils includes more than twenty-four airfoils, the engine includes a bypass ratio greater than six, the engine further includes a fan nozzle disposed adjacent to the aft end of the engine and a gearbox operatively connected to the airfoils so as to reduce the rotational speed of the airfoils, and the fan nozzle maintains a constant area.

15. A method of manufacturing an airfoil, comprising:

forming an airfoil having a suction surface and a pressure surface;

providing at least one suction surface shroud onto the suction surface;

providing a first and second substantially concave portion and a first and second substantially convex portion onto the at least one suction surface shroud;

providing at least one pressure surface shroud onto the pressure surface;

providing a third and fourth substantially concave portion and a third and fourth substantially convex portion onto the at least one pressure surface shroud;

forming the at least one suction surface shroud to include a first contoured section where the first substantially convex portion is adjacent to the first substantially concave portion, the first contoured section forming an angle α of approximately less than 90 degrees with respect to a first mating face of the at least one suction surface shroud and to include a second contoured section where the second substantially convex portion is adjacent to the second substantially concave portion, the second contoured section forming an angle γ of approximately less than 90 degrees with respect to the first mating face, and forming the at least one pressure surface shroud to include a third contoured section where the third substantially convex portion is adjacent to the third substantially concave portion, the third contoured section forming an angle β of approximately less than 90 degrees with respect to a second mating face of the at least one pressure surface shroud and to include a fourth contoured section where the fourth substantially convex portion is adjacent to the fourth substantially concave portion, the fourth contoured section forming an angle θ of approximately less than 90 degrees with respect to the second mating face.

16. The method of claim 15, further including forming the first and second substantially convex portions of the airfoil so as to operationally form a center diamond region with the third and fourth substantially convex portions of an adjacent airfoil, the center diamond region having dimensions that, during operation of a gas turbine engine, maximize resistance of shingling and wear of the at least one suction surface shroud and the at least first one pressure surface shroud.

17. The method of claim 15, further including forming the first and second substantially concave portions so as to operatively form an area-ruled region collectively with the third and fourth substantially concave portions of the adjacent airfoil, the area-ruled region having dimensions that, during operation of the gas turbine engine, allow spreading streamtubes over the center diamond region to flow into the area-ruled region creating an aerodynamic streamlined airflow path over the at least one pressure and suction surface shrouds so that aerodynamic drag is minimized and engine operating efficiency is increased.

* * * * *